United States Patent [19]

Shyu

[11] Patent Number: 4,666,232

[45] Date of Patent: May 19, 1987

[54] PLUG FOR A CAR ANTENNA

[76] Inventor: Don Shyu, No. 28-4, Fan Tze Pou, Tai Ho Village, Che Pei Hsiang, Shin Chu Hsien, Taiwan

[21] Appl. No.: 818,458

[22] Filed: Jan. 13, 1986

[51] Int. Cl.[4] ..... H01R 17/18

[52] U.S. Cl. ..... 339/177 R; 339/183

[58] Field of Search ..... 339/103 R, 103 M, 103 B, 339/103 C, 276 T, 276 R, 278 T, 252 P, 213 R, 177 R, 177 E, 182, 183

[56] References Cited

U.S. PATENT DOCUMENTS

| | | | |
|---|---|---|---|
| 2,389,455 | 11/1945 | Benander | 339/213 R |
| 3,135,571 | 6/1964 | Klinkwitz | 339/182 R |
| 3,742,426 | 6/1973 | Huber et al. | 339/213 R |
| 3,818,420 | 6/1974 | Barr | 339/103 R |
| 4,310,213 | 1/1982 | Fetterolf et al. | 339/103 M |

FOREIGN PATENT DOCUMENTS

| | | | |
|---|---|---|---|
| 876293 | 8/1961 | United Kingdom | 339/103 R |
| 1425401 | 2/1976 | United Kingdom | 339/103 R |
| 2098410 | 11/1982 | United Kingdom | 339/103 R |

*Primary Examiner*—Gil Weidenfeld
*Assistant Examiner*—David Pirlot
*Attorney, Agent, or Firm*—Browdy and Neimark

[57] ABSTRACT

The present invention relates to an improved plug structure for a car antenna, in which the plug has a conductive pin which forms the electrode for connection of electrical cord. The structure comprises an insulative housing, two arch-shaped clamping plates, and the plates are enclosed by a fitting element, while the connection of conductive pin and insulative housing is by means of a star like protrusion which is firmly secured to the housing by casting, such that the pin may not be rotated. The arch-shaped clamping plate acts as a shock absorber which has effective resiliency.

1 Claim, 3 Drawing Figures

PLUG FOR A CAR ANTENNA

BACKGROUND OF THE INVENTION

Generally, a car antenna is connected to a car Hi-Fi set in order to provide effective receiving of electromagnetic waves from broadcasting stations. As a result, a specific plug for such an antenna must be provided for the installation of the aerial.

The conventional type of aerial plug as shown in FIG. 3, which comprises an electrical cord (a) with a core (f) and encloses a conductive portion (d) with an insulative housing (g). At the connection of said conductive portion (d) and electrical core (a), the end of conductive portion (d) is hammered to form a plurality of indentations which enforce the fastening of the connection. Furthermore, the connection of the electrical cord (a) is accomplished by welding the core of electrical core (a) with pin (f) at one end, while the earth wire (net-like structure) (not shown) of the electrical cord is connected to the end of conductive portion (d). Hence, the prior art plug possesses the following drawbacks:

(i) The prior art plug is too rigid and lacks resiliency, therefore, it may be dislocated due to extreme vibration when a car is moving.

(ii) The external surface of the plug has no gripping means, therefore, to plug into a socket of a Hi-Fi set is inconvenient.

SUMMARY OF THE PRESENT INVENTION

It is therefore the primary object of the present invention to provide an improved plug structure for a car antenna, which will alleviate the above-mentioned drawbacks.

It is an object of this invention to provide an improved plug structure for a car antenna enabling an antenna to be readily positioned into a socket of a Hi-Fi set.

Another object of the present invention is to provide an improved plug structure for a car antenna having the function of absorbing shock.

Another object of the present invention is to provide an improved plug structure for a car antenna which can be readily installed on any type of socket on receiving equipment.

Another object of the present invention is to provide an improved plug structure for a car antenna which is durable and inexpensive.

The attainment of the foregoing and related objects, advantages and features of the invention should be more readily apparent after review of the following more detailed description of the invention, taken together with the drawings, in which:

DETAILED DESCRIPTION OF THE INVENTION

Figure 1:
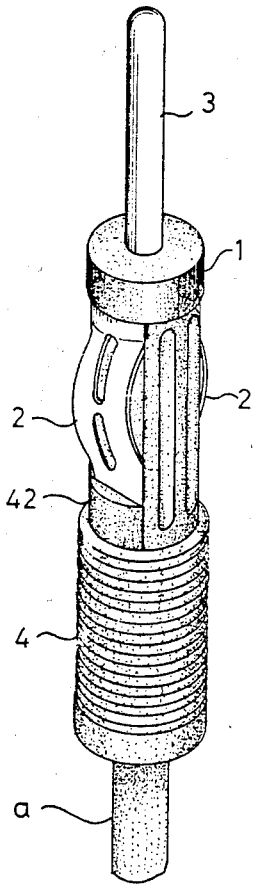
FIG. 1 is a perspective view of an improved plug structure for a car antenna in accordance with the invention.
Figure 2:
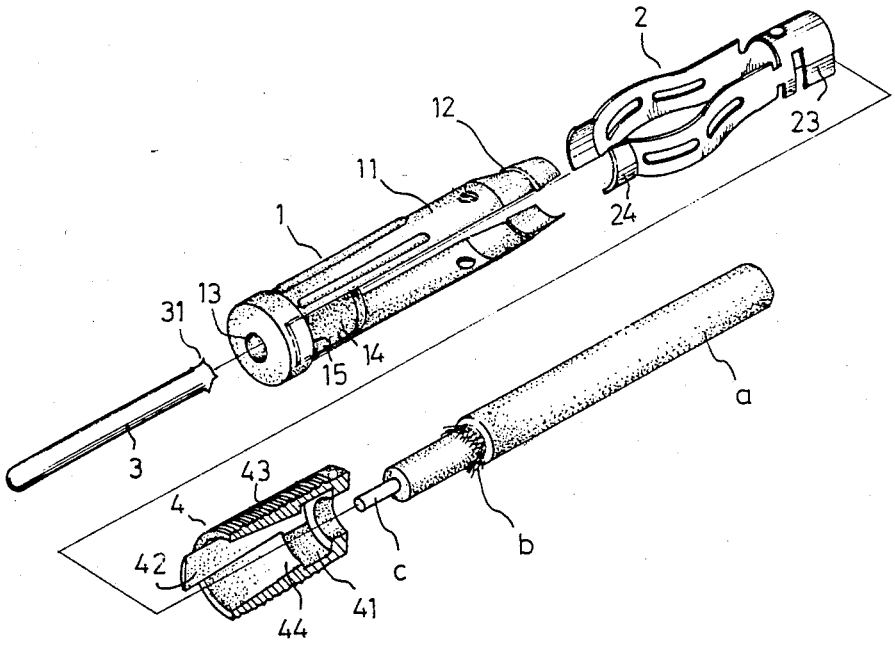
FIG. 2 is a fragmentary perspective view of an improved plug structure for a car antenna in accordance with the invention.
Figure 3:
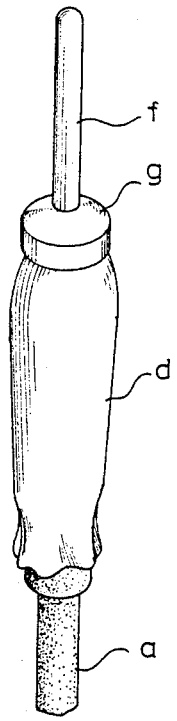
PRIOR ART FIG. 3
FIG. 3 is a perspective view of the prior art.

Turning now to the drawings, more particularly to FIG. 1 and FIG. 2, there is shown an improved plug structure for a car antenna. As shown, the preferred embodiment includes an insulative housing (1), clamping plate (2), pin (3) and fastener (4), wherein in said insulative housing (1), the lower region is designed with a gripping segment (12) which is the extention of an insulative plate (11) such that said fastener (4) can be gripped on it. At the front portion, within the insulative plate (11) of said housing (1), a cylindrical-shaped member (14) having a hole (13) at the center is meant for the pin (3) to be passed therethrough. An electrical cord (a) with its core (c) may be welded to said pin (3) and the fastening of the pin (3) to the cylindrical shaped member (14) is by means of a star-like protrusion (31), which enables the pin (3) to be firmly secured to the insulative housing (1); a clamping plate (2) which is formed by two arch-shaped plates (24). One end of said plate is designed with a U-shaped member (23) which is an extension of said plate (24), the front end of arch-shaped plate (24) can be inserted into the slot (15) provided at the end of insulative housing (1). Within the fastener (4), two parallel plates (42) are mounted which reinforce the fastening of clamping plate (2) while the inner surfaces of fastener (4) have a slanting face (44) and a depression (41) which is meant for the fitting of gripping segment (12) of insulative housing (1).

FIG. 2 illustrates the parts that form the preferred embodiment. On assembly, the pin (3) is fitted into the aperture (13) of cylindrical shaped member (14) and passes through aperture (13). The pin (3) is engaged via the star-like protrusion with the edge of aperture (13). The U-shaped member (23) of the clamping plate (2) is then clamped onto the gripping segment (12) of the insulative housing (1). The core (c) of electrical cord (a) is welded to the pin (3) at one end while the earth wire (b) of electrical cord (a) is welded to U-shaped member (23). Thereafter the fastener (4) is inserted from the end of the housing (1) nearest gripping segment (12) and thus encloses the lower part of insulative housing (1).

It will be seen that there is provided an improved plug structure for a car antenna which achieves the various objects of the invention and which is well adapted to meet the conditions of practical use.

As various possible embodiments might be made of the above invention, and as various modifications might be made in the embodiment above set forth, it is to be understood that all matter herein described or shown in the accompanying drawings is to be intrepreted as illustrative and not in a limiting sense. Thus it will be appreciated that the drawings are exemplary of a preferred embodiment of the invention.

I claim:

1. An improved plug structure for a car antenna comprising:

an insulative housing having a gripping segment at one end of the insulative housing, at the other end and within the housing, a cylindrical shaped member with an aperture at the centre being disposed such that a pin can be inserted through said aperture, said aperture engaging one end of said pin, at one end of the pin a star-like protrusion is designed which also provides for the connection of a core of an electrical cord, and said protrusion is tightly secured to the insulative housing;

two arch-shaped plates and a U-shaped member forming a clamping plate in which the front end of said plate can be fitted or clamped to the insulative housing;

a fastener in which the external surface is threaded so as to provide better gripping, while an internal wall of the fastener is designed with a depression enabling securement to the insulating housing, two parallel plates being used to be inserted between the clamping plate and fastener to provide excellent fastening of the plug.

* * * * *